US009767670B2

(12) United States Patent
Kraeutler

(10) Patent No.: US 9,767,670 B2
(45) Date of Patent: Sep. 19, 2017

(54) DOOR HAVING A FLEXIBLE CURTAIN AND A WIRELESS EMITTER INSIDE THE CURTAIN

(71) Applicant: NERGECO, Dunieres (FR)

(72) Inventor: Bernard Kraeutler, Dunieres (FR)

(73) Assignee: ASSA ABLOY ENTRANCE SYSTEMS AB, Landskrona (SE)

( * ) Notice: Subject to any disclaimer, the term of this patent is extended or adjusted under 35 U.S.C. 154(b) by 0 days.

(21) Appl. No.: 14/403,172

(22) PCT Filed: Apr. 16, 2013

(86) PCT No.: PCT/FR2013/050836

§ 371 (c)(1),
(2) Date: Nov. 22, 2014

(87) PCT Pub. No.: WO2013/175090

PCT Pub. Date: Nov. 28, 2013

(65) Prior Publication Data

US 2015/0082701 A1 Mar. 26, 2015

(30) Foreign Application Priority Data

May 24, 2012 (FR) ..... 12 54783

(51) Int. Cl.
*G08B 21/18* (2006.01)
*E06B 9/88* (2006.01)
(Continued)

(52) U.S. Cl.
CPC ..... *G08B 21/185* (2013.01); *E05F 15/42* (2015.01); *E05F 15/43* (2015.01); *E05F 15/60* (2015.01);
(Continued)

(58) Field of Classification Search
CPC ..... G08B 21/185; E05F 15/42; E05F 15/43; E05F 15/48; E06B 9/0692; E06B 9/17046;
(Continued)

(56) References Cited

U.S. PATENT DOCUMENTS 5,426,293 A * 6/1995 Miller et al. ..... 250/221
5,728,984 A * 3/1998 Miller ..... 200/61.43
(Continued)

FOREIGN PATENT DOCUMENTS

EP 1245774 A1 10/2002
EP 2075399 A2 7/2009
(Continued)

OTHER PUBLICATIONS

International Search Report issued Aug. 12, 2013 re: PCT/FR2013/050836, citing: FR 2 877 684 A1, EP 2 075 399 FR 2 917 116 A1 and EP 1 245 774 A1.

*Primary Examiner* — Gregory Strimbu
(74) *Attorney, Agent, or Firm* — Cantor Colburn LLP

(57) ABSTRACT

A flexible curtain has a ballasting and sealing element and a reinforcing element, and is able to move between an open position and a closed position. The door comprises a detection unit configured to detect an encounter of the ballasting and sealing element with an obstacle. The door also comprises a wireless emitter arranged inside the curtain, close to an upright, in a lateral region of the curtain. The emitter cooperates with the detection unit and emits a radio signal when the obstacle is detected by the detection unit. The radio signal is received by a receiver which cooperates with a driving unit so as to stop or reversely move the curtain.

7 Claims, 8 Drawing Sheets

(51) Int. Cl.

| | |
|---|---|
| ***E06B 9/17*** | (2006.01) |
| ***E05F 15/42*** | (2015.01) |
| ***E05F 15/43*** | (2015.01) |
| ***E05F 15/60*** | (2015.01) |
| ***E05F 15/74*** | (2015.01) |
| ***E05F 15/77*** | (2015.01) |
| *E06B 9/06* | (2006.01) |
| *E05F 15/47* | (2015.01) |
| *E05F 15/48* | (2015.01) |
| *E05F 15/73* | (2015.01) |

(52) U.S. Cl.
CPC ..... *E05F 15/74* (2015.01); *E05F 15/77* (2015.01); *E06B 9/17046* (2013.01); *E06B 9/88* (2013.01); *E05F 15/47* (2015.01); *E05F 15/48* (2015.01); *E05F 2015/765* (2015.01); *E05Y 2900/00* (2013.01); *E05Y 2900/106* (2013.01); *E06B 9/0692* (2013.01); *E06B 2009/885* (2013.01)

(58) Field of Classification Search
CPC ..... E06B 9/88; E06B 2009/885; E06B 2009/6836
USPC ..... 160/8, 188, 310
See application file for complete search history.

(56) References Cited

U.S. PATENT DOCUMENTS

| | | | | |
|---|---|---|---|---|
| 6,732,476 | B2 * | 5/2004 | Mehalshick et al. | 49/506 |
| 7,518,326 | B2 * | 4/2009 | Shier et al. | 318/286 |
| 2004/0187406 | A1 * | 9/2004 | Gallagher et al. | 52/173.1 |
| 2007/0261305 | A1 * | 11/2007 | Kraeutler | 49/27 |
| 2008/0231442 | A1 * | 9/2008 | Schafer et al. | 340/540 |
| 2010/0065231 | A1 * | 3/2010 | Kraeutler | E06B 9/56 160/331 |
| 2010/0212841 | A1 * | 8/2010 | Iglesias Ballester | 160/133 |
| 2010/0236725 | A1 * | 9/2010 | Kraeutler | E06B 9/80 160/1 |
| 2012/0255231 | A1 * | 10/2012 | Jenkins et al. | 49/358 |
| 2013/0133843 | A1 * | 5/2013 | Kraeutler | 160/188 |

FOREIGN PATENT DOCUMENTS

| | | | |
|---|---|---|---|
| FR | 2877684 | A1 | 5/2006 |
| FR | 2917116 | A1 | 12/2008 |
| JP | 742466 | A | 2/1995 |
| JP | 9228768 | A | 9/1997 |
| JP | 2004293173 | A | 10/2004 |
| JP | 2007170132 | A | 7/2007 |
| JP | 2008519185 | A | 6/2008 |

* cited by examiner

DOOR HAVING A FLEXIBLE CURTAIN AND A WIRELESS EMITTER INSIDE THE CURTAIN

TECHNICAL FIELD

The present invention relates to an automatic door with flexible curtain.

BACKGROUND

Automatic doors with flexible curtain typically comprise two lateral uprights, a transverse case connecting the upper ends of the lateral uprights, and a curtain movable between a closing position in which it obstructs the opening formed by the transverse uprights and the case and an opening position in which the curtain is folded or rolled into the case. Driving means, conventionally arranged in or on one of the sides of the case, allow displacement of the curtain from the closing position to the opening position and vice versa.

An important issue in the field of the automatic doors with flexible curtain concerns securing the operation of these doors in order to avoid, during displacement of the curtain from the opening position to the closing position, a collision between the curtain on the one hand and a person or a vehicle on the other hand, which may cause injury to the person or deterioration of the vehicle and/or deterioration of the curtain.

A solution known from patent FR2877684 consists of integrating into the curtain means for detecting an encounter with an obstacle in order to secure the operation of the door. The means for detecting an encounter with an obstacle are connected by a wired connection to the electronics or electromechanics for controlling the driving means of the curtain. Therefore, the triggering of the means for detecting an encounter with an obstacle allows for example, via the control electronics or electromechanics, ordering the driving means to stop the closing of the curtain and to move it in the opposite direction in order to open it.

This solution offers high reliability of detection of an obstacle and allows quite satisfactorily to preserve the physical integrity of the vehicle or of the person accidentally hit by the curtain, and the physical integrity of the curtain itself.

However, the wired connection connecting the detection means to the control electronics or electromechanics is at least partially exposed to attack from the outside environment.

This may be problematic when the door is for example exposed to bad weather and hydrometric variations, due to the increased risk of deterioration of the quality of the electrical connection. In addition, the wired connection is easily accessible; thus it risks to be sectioned, accidentally when a vehicle passes nearby or with malicious intent.

Moreover, given the speed of displacement of the curtain and the frequency of its displacements, the wired connection between the means for detecting an encounter with an obstacle and the control electronics or electromechanics is subject to a risk of premature wear, or even breakage upon a displacement of the curtain. This results in reliability problems that can be limited only by means of regular maintenance.

Then, the wired connection is limitative in terms of dimensioning of the door that it equips; it is difficult to implement as a solution to detect obstacles similar to that described in the patent FR2877684 for a door of significant dimensions, for example intended for the passage of an aircraft into or out of a hangar.

Finally, and most importantly, within the framework of applications in the fields of pharmaceuticals or food processing, the door can mark the entry or exit point of a clean room and must thus be cleaned regularly. However, cleaning the wired connection, typically a spiral wire that extends or retracts as to whether the door closes or opens, may be tedious when done by hand, or can cause premature wear of this wired connection when it is carried out by means of cleaning products which can be corrosive (after a number of cleaning operations, the spiral wire gradually loses its flexibility and could end up breaking).

BRIEF SUMMARY

The present invention aims to overcome all or part of these drawbacks by proposing a door with flexible curtain offering high efficiency of detection of obstacles and great ease of cleaning, while being less sensitive to attack from the outside environment and the main causes of premature wear.

To this end, the present invention provides a door with flexible curtain comprising a structure including uprights and a transverse element allowing to guide a flexible curtain provided with a ballasting and sealing element at its free end and at least one reinforcing element parallel to the ballasting and sealing element, the door also comprising driving means supported by the structure allowing to maneuver the curtain between an opening position and a closing position, and means for detecting encounter with an obstacle likely to cause, when activated, the stopping and/or reverse displacement of the curtain, carried at least partly by a supporting element and integrated within the lower part of the curtain, the means for detecting encounter with an obstacle being situated upstream of the ballasting and sealing element, on the closing trajectory of the curtain, between the reinforcing element and the ballasting and sealing element, characterized in that the door comprises at least one emitter, each emitter cooperating with the means for detecting encounter with an obstacle in order to emit a radio signal following the triggering of the means for detecting encounter with an obstacle, the radio signals emitted by each emitter can be received by at least one receiver cooperating with the means for driving the curtain consecutively to the triggering of the means for detecting encounter with an obstacle, and in that the curtain comprises at least one support means arranged in proximity to one of the uprights in order to support each emitter in a lateral area of the curtain.

Therefore, the door according to the invention equipped with a wireless connection is freed from the traditional constraints connected to wired connections, particularly in terms of the time spent to the cleaning of this wired connection, in terms of attack from the outside environment and in terms of wear of this wired connection. The door according to the invention allows thus transmitting with great reliability a signal following the triggering of the detection means.

Moreover, it is noted that the arrangement of the emitter in a lateral area of the curtain, that is to say in an area of little exposure to collision risks, substantially limits the risk of deterioration of the emitter which may result from the accidental collision of a vehicle or a person with the curtain.

It is noted that, the means for detecting encounter with an obstacle may correspond to means for detecting encounter with an obstacle by contact, that is to say, they may correspond to means for detecting a contact between the curtain and an obstacle.

According to a characteristic of the door according to the invention, the communication between each receiver and each emitter is bidirectional in order to control a state of correct operation of each emitter.

According to a form of execution, each emitter comprises a secondary receiver, each receiver integrating at least one secondary emitter capable of emitting a radio signal towards the secondary receiver of each emitter in order to control the state of correct operation of each emitter.

Advantageously, the state of correct operation corresponds to a charge level of at least one built-in battery or battery cell integrated into each emitter greater than a predetermined charge level threshold.

According to one possibility, the receiver is configured to control a state of correct operation of each emitter only during the displacement of the curtain towards the closing position.

This has the advantage of limiting the energy consumption of each emitter, thus increasing their battery life.

Advantageously, the door comprises alerting means intended to inform a user of the absence of the state of correct operation of the emitter or at least one of the emitters.

According to an embodiment, the emitter or the at least one of the emitters onboard at least one amplifier of an infrared signal transmitted between an emitting cell and a receiving cell of the means for detecting encounter with an obstacle.

Therefore, the amplifier of the infrared signal is less exposed to the risk of breakage following a contact between the curtain and an obstacle, this contact leading to the cutoff of the infrared signal by deformation of the ballasting and sealing element.

According to one embodiment, each support means corresponds to at least one pocket adapted to contain the emitter or the at least one of the emitters.

According to an embodiment, the pocket is arranged inside the curtain.

According to one possibility, the pocket is suspended from a sleeve containing the supporting element, and is attached to the sleeve by welding.

The pocket can be suspended from the sleeve containing the supporting element of the cells, when the means for detecting encounter with an obstacle comprise emitting/receiving cells.

According to a form of execution, the curtain comprises an inspection shutter arranged to permit access to the emitter or at least one of the emitters.

The inspection shutter may advantageously offer direct access to the emitter or the at least one of the emitters, or give access to the pocket if this emitter is placed in the pocket.

According to one possibility, each emitter is spaced apart from one of the uprights by a distance comprised between 5 cm and 40 cm, preferably between 10 cm and 15 cm.

Advantageously, the emitter or the at least one of the emitters is arranged inside the curtain, preferably in the lower part of the curtain between the reinforcing element and the ballasting and sealing element.

An emitter placed outside risks indeed de be clung and deteriorated in the case of a light touch of the curtain by a person or a vehicle.

In addition, the emitter placed in the lower part of the curtain is in proximity to the means for detecting encounter with an obstacle. The required connection between the emitter and the means for detecting encounter with an obstacle is thus easier to implement.

Advantageously, the alerting means may comprise at least one indicator lamp. This indicator lamp is placed to be easily visible to a user.

According to one possibility, the supporting element coincides with the reinforcing element.

BRIEF DESCRIPTION OF THE DRAWINGS

Other characteristics and advantages of the present invention will become apparent from the below description of an embodiment of the invention, given by way of non-limiting example, with reference to the accompanying drawings in which.

DETAILED DESCRIPTION

Figure 1:
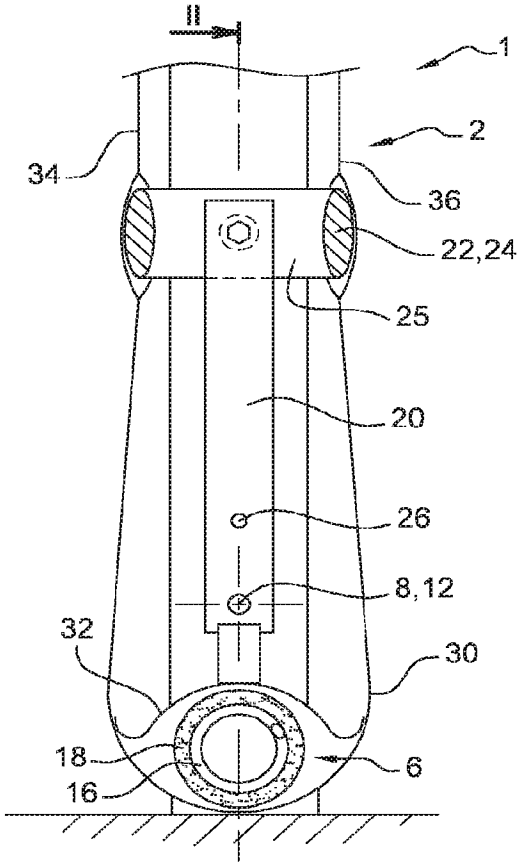
FIGS. 1 and 3 are partial cross-sectional side views of the lower part of a vertical rolling door curtain according to an embodiment of the invention (emitter not visible)
Figure 3:
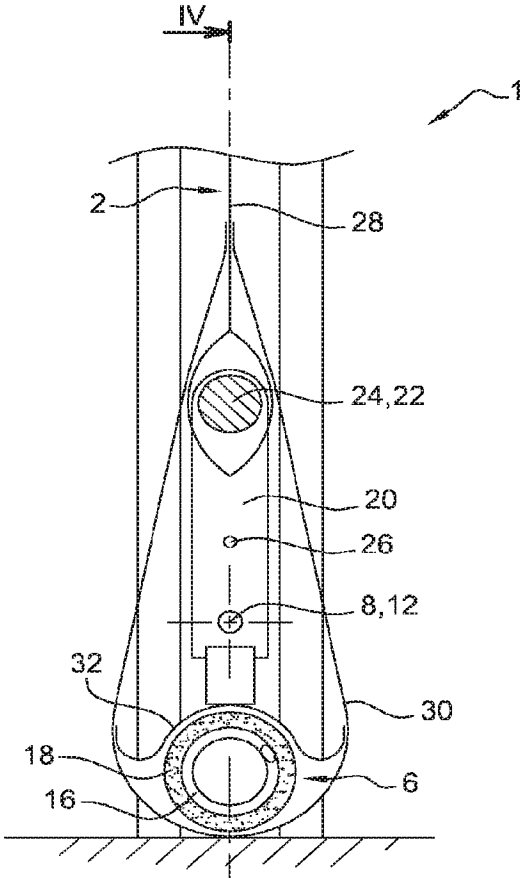

FIGS. 1 and 3 show the lower part of a door 1 with vertical rolling flexible curtain 2.

Generally, it is about doors having a structure comprising uprights 4 and a transverse element 5 allowing to guide the curtain 2, and driving means 3 (electric motor, reducer, control electronics or electromechanics) supported by the structure allowing to maneuver the curtain 2 between an opening position and a closing position.

Figure 2:
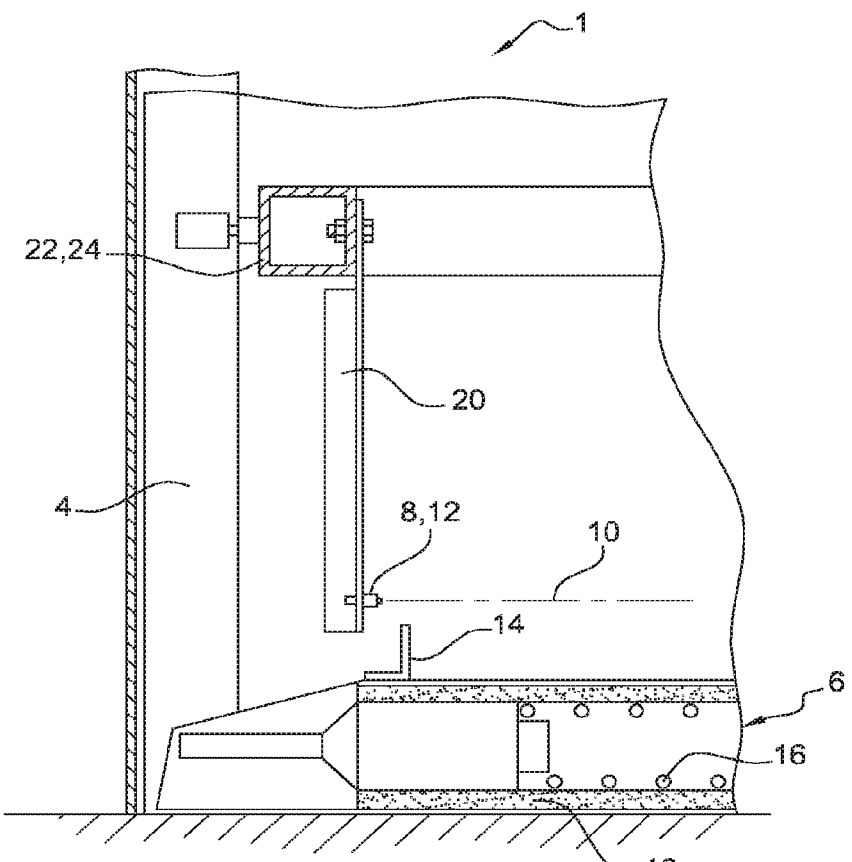
FIGS. 2 and 4 are sectional views, respectively along line II-II of FIG. 1 and line IV-IV of FIG. 3.
Figure 4:
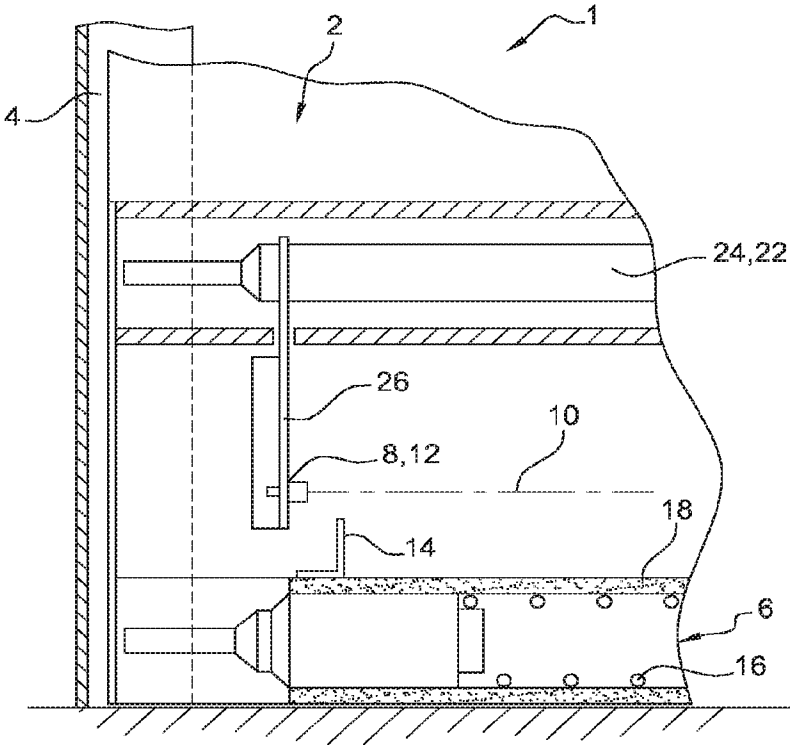

As is also visible in FIGS. 2 and 4, the curtain 2 comprises at its free end a ballasting and sealing element 6 and means for detecting encounter with an obstacle, such as those described in the patent document FR2877684.

According to the embodiment illustrated in FIGS. 1 to 11 and given by way of example, the means for detecting encounter with an obstacle comprise an emitting cell 8, that emits an optical (infrared) beam 10 parallel to and upstream of the ballasting and sealing element 6, and a receiving cell 12 arranged facing the emitting cell 8. An emitting/receiving cell cooperating with a passive beam-return cell can also be considered. Several emitting cell 8/receiving cell 12 couples can also be considered in order to increase the width of the door 1. The detecting means also comprise at least one detecting flag 14 for each emitting cell 8/receiving cell 12 couple. The detecting flag 14 can be constituted by an L-profile. It is supported here by the ballasting and sealing element 6.

The operation of the detecting device is as follows. When the ballasting and sealing element 6 encounters an obstacle during its descent, it deforms as it is constituted for its essential part by a spring 16 and a foam sheath 18. The deformation of the ballasting and sealing element 6 modifies the base of the detecting flag 14 which cuts off the beam 10 which is normally parallel to the ballasting and sealing element 6. The beam 10 being cutoff, a signal is sent to the control electronics or electromechanics of the door 1 which then gives the order, on the one hand, to stop the closing of the curtain 2, and on the other hand, to re-open it.

As is visible in FIGS. 1 to 4, the emitting cell 8 and the receiving cell 12 are each supported by a prop 20. Each prop 20 is here fastened to a supporting element 22. The supporting element 22 is substantially parallel to the ballasting and sealing element 6 and allows supporting the means for detecting encounter with an obstacle. The supporting element 22 may correspond to a reinforcing element 24 or a transverse stiffening bar integrated into the curtain 2, as is the case in FIGS. 1 to 5, or be dissociated therefrom, as is the case in FIGS. 6 to 8.

According to one possibility, each reinforcing element 24 is guided but not retained, and is adapted to withstand multidirectional shocks.

It is noted that each prop 20 may present a plurality of areas 26 for hosting the emitting cell 8 or the receiving cell 12, such that the center distance existing between the ballasting and sealing element 6 and the axis of the beam 10 can be varied.

According to the embodiment illustrated in FIGS. 1 and 2, it is noted that the curtain 2 presents, not only a single apron, but two aprons 34, 36. At the end of the curtain 2, a U-shaped tarpaulin 30 fixed to each one of the aprons 34, 36 is provided, in which a sleeve 32 receiving the ballasting and sealing element 6 is formed. In addition, the curtain 2 can comprise two adjacent reinforcing elements 24 connected by a spacer 25.

In the embodiment of FIGS. 3 and 4, it is noted that the curtain 2 presents a single apron 28 which, at its lower end, presents a U-shaped tarpaulin 30 which is fixed on each one of the faces of the apron. A sleeve 32 is formed in the U-shaped tarpaulin in order to receive the ballasting and sealing element 6.

Figure 5:
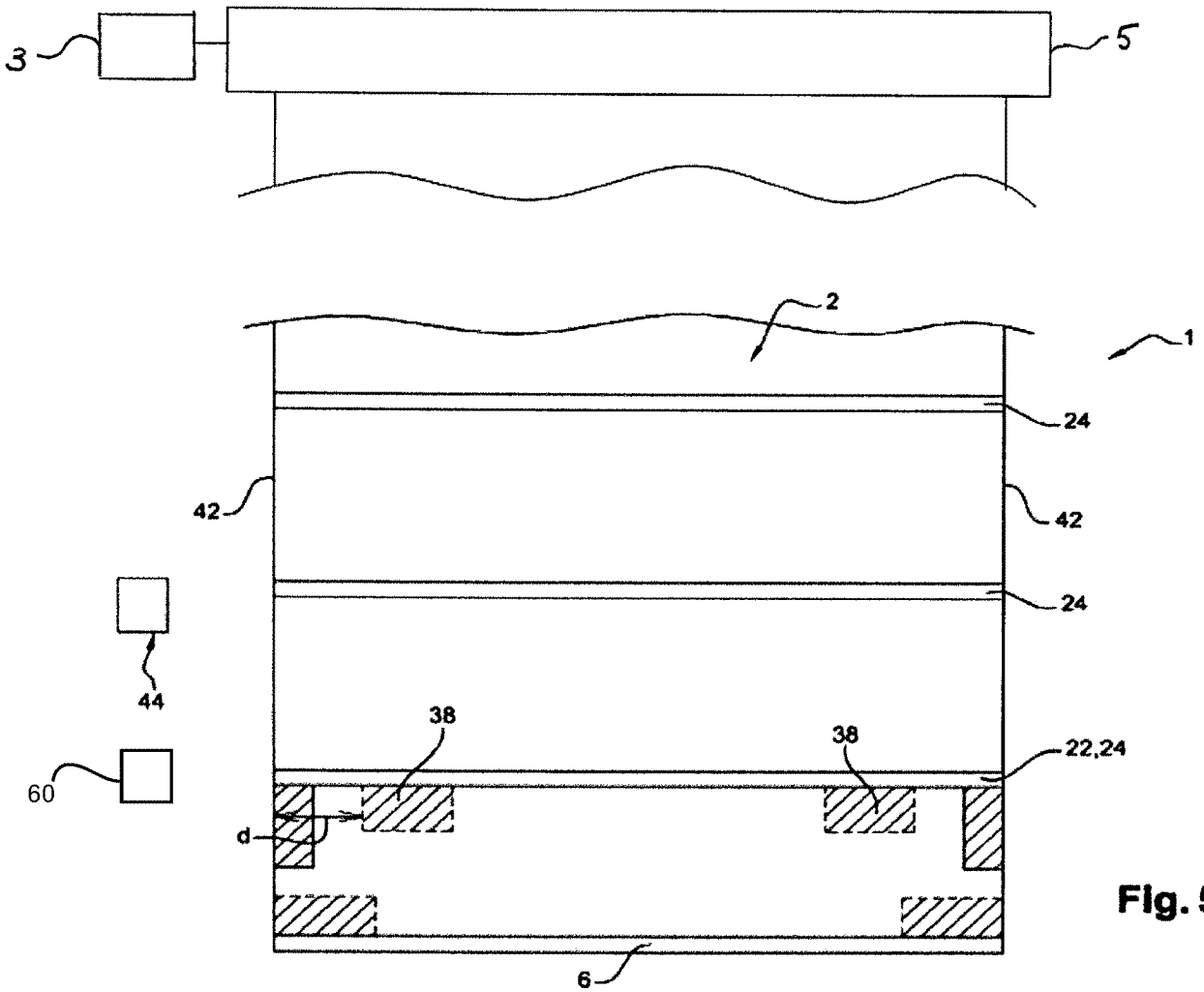
FIG. 5 is a schematic front view of the vertical rolling door curtain.

As is visible in FIG. 5, the door 1 comprises quite remarkably at least one emitter 38 intended to cooperate with the means for detecting encounter with an obstacle in order to emit a radio signal following the triggering of the means for detecting encounter with an obstacle. Therefore, each receiving cell 12 can be connected to an emitter 38, for example by a wired connection 40.

When the door 1 comprises several emitters 38, the emitters 38 operate independently of one another.

According one a possibility, the door 1 comprises at least two detecting assemblies, for example at least two emitting cell 8/receiving cell 12 couples, and two emitters 38, each emitter 38 being associated with one of the detecting assemblies.

Therefore, quite advantageously, the alignment of several detecting assemblies aligned parallel to the ballasting and sealing element 6 and associated each with an emitter 38 allows the production of doors 1 of large width. For example, the door 1 may comprise two beams 10 of 5 m, each one associated with an emitter 38 independent of one another, in order to produce a door 1 with a width of approximately 10 m.

In the example of FIG. 5, two emitters 38 have been represented.

As can be seen in FIG. 5, the emitters 38 are remarkably arranged in proximity to one of the uprights 4, in other words in proximity to one of the lateral edges 42 of the curtain 2. Quite advantageously, the emitters 38 are therefore situated in an area less exposed to the risks of collision with a person or a vehicle.

Each emitter 38 is distant from one of the uprights 4 by a predetermined distance d which may be comprised between 5 cm and 40 cm, and preferably between 10 cm and 15 cm.

Each emitter 38 can cooperate with a receiver 44 located in the vicinity of the door 1, that is to say by a distance which enables the establishment of a radio connection between each emitter 38 and the receiver 44.

The receiver 44 can be single.

The receiver 44 is adapted to receive the radio signals emitted by each emitter 38. The receiver 44 is intended to cooperate with control electronics or electromechanics in order to control the means for driving the curtain 2 so as to stop and/or move the curtain 2 consecutively to the triggering of the means for detecting encounter with an obstacle.

It is noted that, advantageously, when the door 1 comprises a detecting assembly with infrared beam 10, the emitter 38 associated with this detecting assembly can onboard at least one amplifier 60 of an infrared signal transmitted between the emitting cell 8 and the receiving cell 12 of this detecting assembly.

Quite remarkably, the communication between each emitter 38 and the receiver 44 is bidirectional.

In other words, the radio signals can be emitted from each emitter 38 to the receiver 44, and from the receiver 44 to each emitter 38. The frequency can be for example in the order of 2.4 GHz.

The communication can be simultaneous for a better response time (the emitter 38 and the receiver 44 can emit and receive signals simultaneously).

Thus, the receiver 44 is capable of monitoring a state of correct operation of each emitter 38, at least during the displacement of the curtain 2 up to the closing position and, where appropriate, only in this case in order to increase the battery life of the emitters 38.

The receiver 44 may for example examines each emitter 38 about the charge level of the battery cell(s) or battery(ies) it integrates in order to supply.

According to one possibility, the receiver 44 can therefore integrate at least one secondary emitter (not represented) capable of emitting a radio signal, and each emitter 38 can integrate a secondary receiver (not represented) capable of receiving one of the radio signals emitted by the secondary emitter or one of the secondary emitters integrated into the receiver 44.

The door 1 can comprise alerting means, for example an indicator lamp (not represented), intended to alert a user when the receiver 44 has detected a low level of battery charge for the emitter or one of the emitters 38.

In this case, the indicator lamp illuminates in order to indicate this low battery state to a user, and it can be considered to move the curtain 2 to the opening position while awaiting the intervention of an operator.

Figure 11:
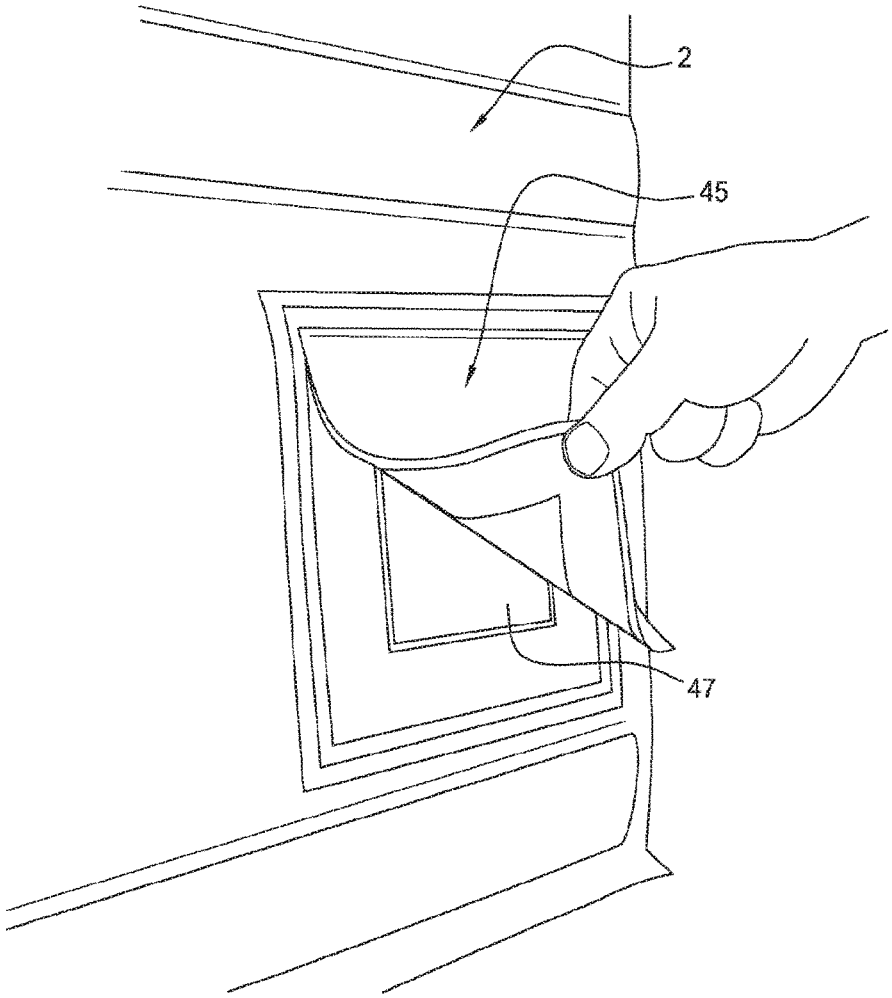
FIG. 11 is a perspective view showing an inspection shutter of the door curtain according to an embodiment of the invention.

The operator may proceed to the replacement of the used battery cell or battery by moving the curtain 2 in maintenance mode and accessing, where appropriate, the concerned emitter 38 via an inspection shutter 45, visible in FIG. 11.

Each inspection shutter 45 is arranged to permit access to an emitter 38. The inspection shutter 45 may correspond to a cutout arranged in the curtain 2 in order to delimit an opening 47 permitting access to the emitter 38. It may comprise closing means, for example of the hook and loop types, intended to maintain the cutout folded over the opening 47 in order to obstruct it.

The inspection shutter 45 is arranged in proximity to the emitter 38. It is dimensioned in order to allow passage of the emitter 38 through the opening 47 it delimits. Ideally, the inspection shutter 45 is also shaped in order to permit access to means for detecting encounter with an obstacle. It may thus allow the replacement of an emitting cell 8 or a receiving cell 12.

At least one support means, such as a pocket 46 represented in FIGS. 6 to 10, allows supporting each emitter 38.

The pocket 46 may correspond to a PVC canvas; its dimensions (for example length L in the order of 300 mm and height h in the order of 120 mm) are adapted to contain the emitter 38 (the dimensions of which can be in the order of 15 cm in length, 3 cm in height and 2 cm in width).

The pocket 46 is arranged in proximity to one of the uprights 4 in order to support each emitter 38 in a lateral area of the curtain 2.

Figure 6:
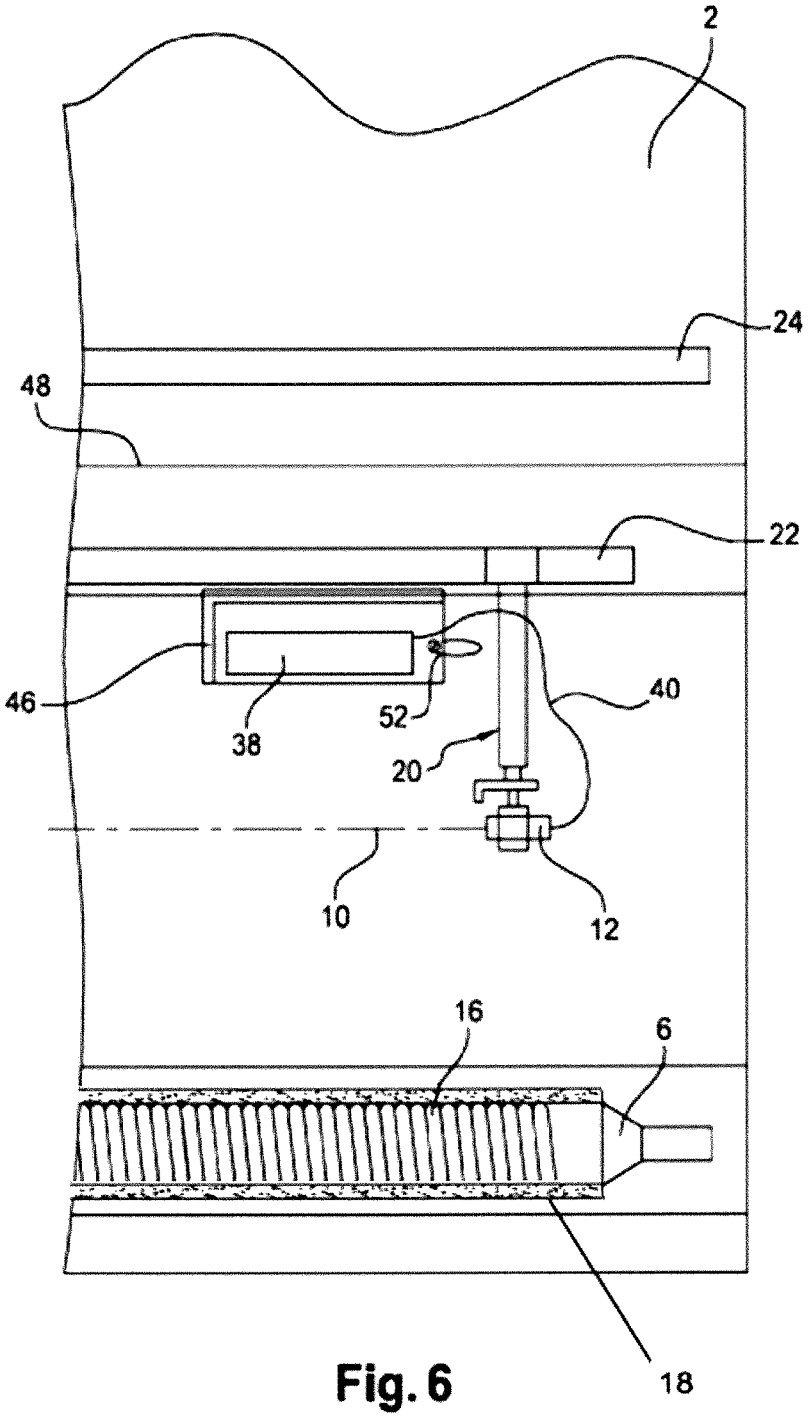
FIG. 6 is a front view of the inside of the lower part of a vertical rolling door curtain.
Figure 7:
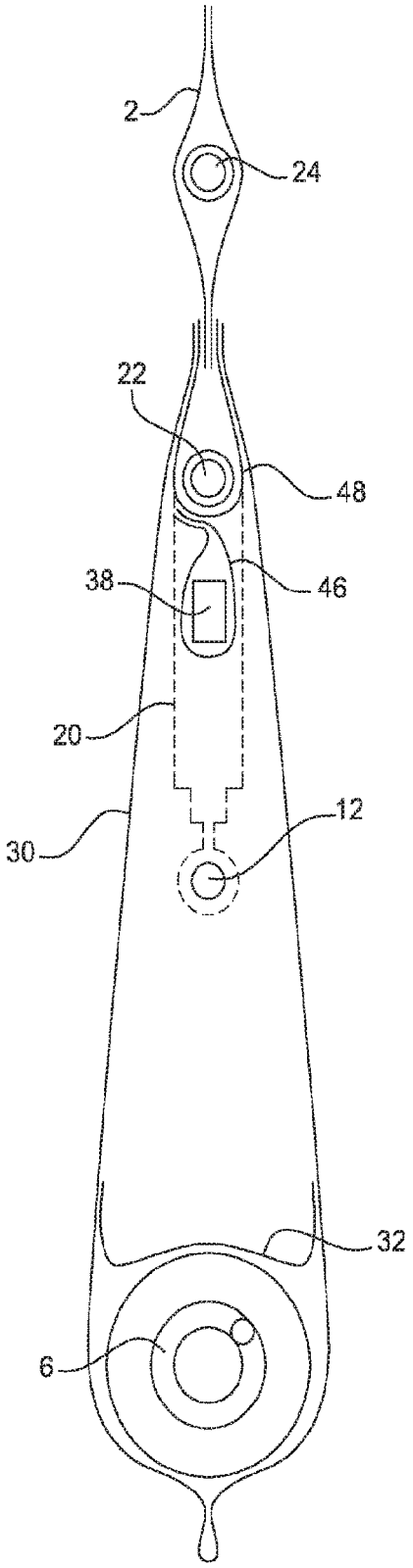
FIG. 7 is a schematic perspective and partial sectional view of the lower part of a vertical rolling door curtain.
Figure 8:
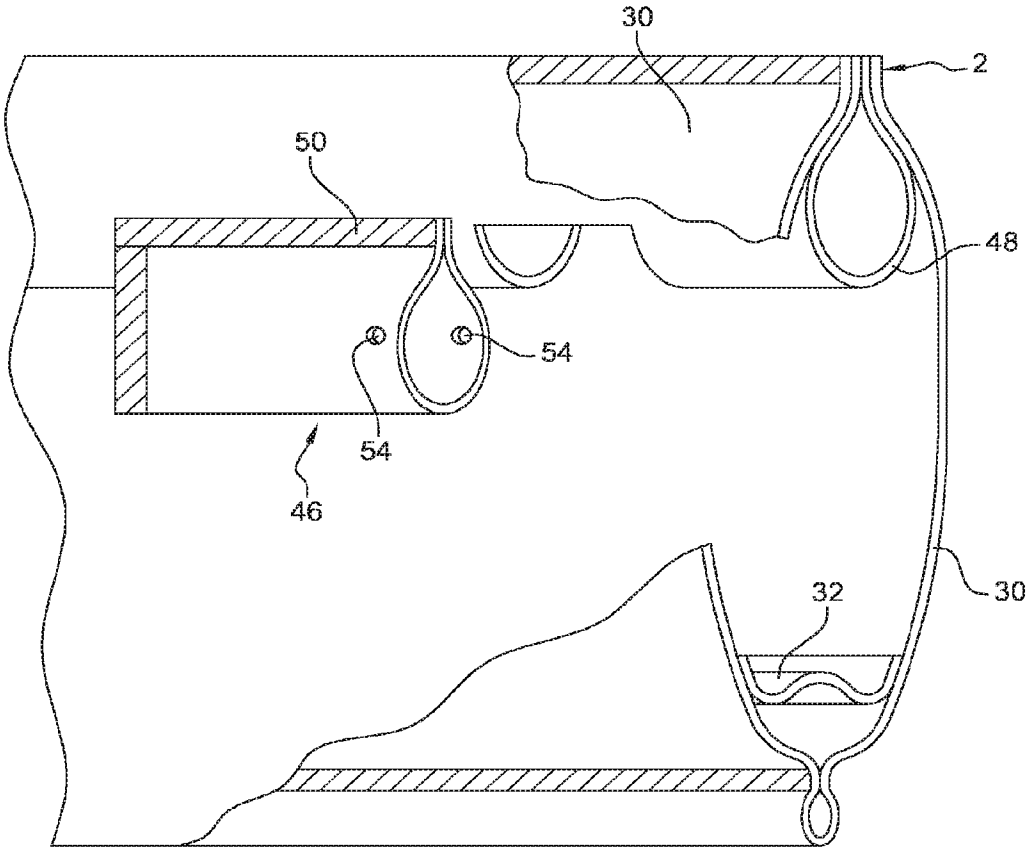
FIG. 8 is a schematic sectional and profile view of the lower part of a vertical rolling door curtain.

According to the embodiment illustrated in FIGS. 6 to 8, the pocket 46 is situated in the curtain 2, such that the emitter 38 it contains is situated in the curtain 2. More precisely, the pocket 46 may be arranged in the lower part of the curtain 2, in particular in the U-shaped tarpaulin 30, between the reinforcing element 24 or the supporting element 22 and the ballasting and sealing element 6. The emitter 38 it contains is therefore in immediate proximity to the means for detecting encounter with an obstacle.

As is visible in FIGS. 6 to 8, the pocket 46 may be suspended from a sleeve 48 containing the supporting element 22. An upper portion 50 of the pocket 46 is for example welded to the sleeve 48.

Figure 10:
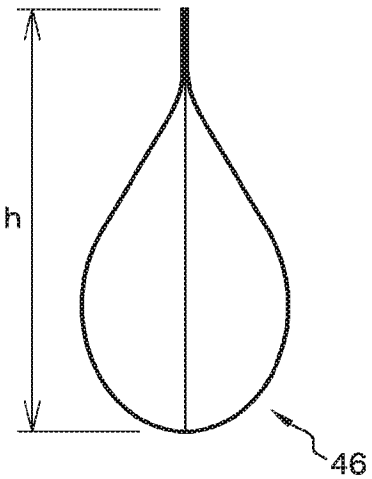
FIGS. 9 and 10 are respectively front and profile views of a pocket for supporting an emitter of a door according to an embodiment of the invention.
Figure 9:
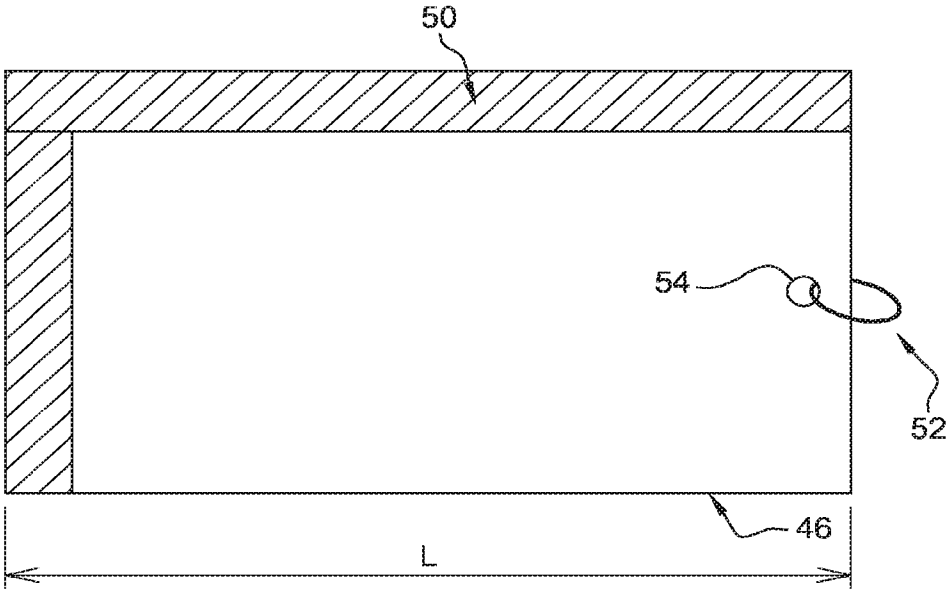

As is visible in FIGS. 9 and 10, the pocket 46 may correspond to a cutout, two opposite edges of which are folded one against the other and welded to one another in order to delimit an internal volume intended to receive the emitter 38. The pocket 46 comprises two ends, one of which (FIG. 10) is locked (welded edges) and the other of which (to the right of FIG. 9) is intended to allow the insertion or removal of the emitter 38 in or out of the pocket 46.

Closing means, for example of the snap button, hook and loop, slide fastener, or self-locking collar types 52 (inserted in holes 54 arranged on the pocket 46), allow closing the end intended to the insertion or removal of the emitter 38.

Of course, the invention is in no way limited to the embodiment described above, this embodiment having been given only by way of example. Modifications remain possible, especially from the point of view of the constitution of the various elements or by the substitution of technical equivalents, without for all that departing from the field of protection of the invention.

Therefore, the invention can also be applied to doors with horizontal or vertical folding or rolling flexible curtain.

It is noted that the means for detecting encounter with an obstacle is not limited to an infrared beam transmitted between an emitting cell and a receiving cell. They may also comprise a mechanical system with a cable which, at one of its ends, is retained by a spring at a prop 20 and, at its other end, is retained through a pull-type contact. It is also conceivable to use an air flange associated with a pressure switch.

When the door 1 comprises several aligned detecting assemblies, these may be of different types (for example infrared system and mechanical system). Where appropriate, the emitters 38 are configured to receive the signals outputted by the detecting assembly to which they are associated.

The invention also allows the production of assemblies comprising several doors 1 and a single receiver 44 placed in the vicinity of each one of these doors 1 in order to cooperate with the emitter 38 or the emitters 38 of each one of the doors 1.

The invention claimed is:

1. A door system comprising a flexible curtain and a structure, said structure including uprights for guiding said flexible curtain, the flexible curtain having a ballasting and sealing element, a free end provided with said ballasting and sealing element, and at least one reinforcing element parallel to the ballasting and sealing element, wherein the door system also comprises a driving unit supported by the structure, the driving unit being configured to drive the curtain between an opening position and a closing position, and a detection unit configured to detect an encounter of the curtain with an obstacle, said encounter causing, when the detection unit is activated, a stopping or a reverse displacement of the curtain, the detection unit being carried at least partly by the reinforcing element which is integrated within a lower part of the curtain, the detection unit being situated upstream of the ballasting and sealing element along a closing trajectory of the curtain between the reinforcing element and the ballasting and sealing element, wherein the curtain includes at least one emitter, said at least one emitter cooperating with the detection unit in order to emit a radio signal following a triggering of the detection unit, the radio signal emitted by said at least one emitter being received by at least one receiver cooperating with the driving unit, and the curtain comprises at least one support member adjacent one of the uprights in order to support said at least one emitter in a lateral area of the curtain, and wherein said at least one emitter is arranged inside the curtain, and wherein the curtain comprises an inspection shutter arranged to permit access to the at least one emitter through a cutout arranged on one face of the flexible curtain, and wherein the curtain includes at least one flexible pocket therein containing the at least one emitter.

2. The door system according to claim 1, wherein the at least one emitter is spaced from said one of the uprights by a distance between about 5 cm and about 40 cm.

3. The door system according to claim 1, wherein communication between the at least one receiver and said at least one emitter is bidirectional in order to verify that a charge level of a battery device integrated into said at least one emitter is greater than a predetermined charge level threshold.

4. The door system according to claim 3, wherein said at least one emitter comprises a secondary receiver, said at least one receiver comprising at least one secondary emitter capable of emitting a radio signal towards the secondary receiver of said at least one emitter in order to control operation of said at least one emitter.

5. The door system according to claim 4, wherein the secondary receiver is configured to control said operation of the at least one emitter only during displacement of the curtain toward the closing position.

6. The door system according to claim 3, further comprising an alerting device for informing a user of an error in the operation of the at least one emitter.

7. The door system according to claim 1, further comprising at least one amplifier of an infrared signal transmitted between an emitting cell and a receiving cell of the detection unit.

* * * * *